US005653134A

United States Patent [19]

Lee et al.

[11] Patent Number: 5,653,134

[45] Date of Patent: Aug. 5, 1997

[54] MAGNETIC CARD KEY-OPERATED LOCKING DEVICE

[76] Inventors: Jae-hak Lee, 5-801 Daegyo Apt. Yeoido-dong, Youngdeungpo-ku, Seoul; Kyung-soo Kim, 249-105 Mook 2 dong, Choongryang-ku, Seoul, both of Rep. of Korea

[21] Appl. No.: 540,091

[22] Filed: Oct. 6, 1995

[30] Foreign Application Priority Data

Nov. 17, 1994 [KR] Rep. of Korea ..... 94-30313

[51] Int. Cl.[6] ..... E05B 47/00

[52] U.S. Cl. ..... 70/276; 70/387; 292/DIG. 27; 292/169.18

[58] Field of Search ..... 70/276, 413, 387, 70/150, 153; 292/DIG. 27, 169.14, 189.15, 169.18

[56] References Cited

U.S. PATENT DOCUMENTS

| | | | |
|---|---|---|---|
| 3,834,197 | 9/1974 | Sedley | 70/276 |
| 3,995,460 | 12/1976 | Sedley | 70/276 |
| 4,676,083 | 6/1987 | Sedley et al. | 70/276 |
| 4,932,228 | 6/1990 | Eisermann | 70/276 |
| 5,339,661 | 8/1994 | Eisermann | 70/276 |
| 5,406,815 | 4/1995 | Sedley | 70/276 |

FOREIGN PATENT DOCUMENTS

| | | | |
|---|---|---|---|
| 0024242 | 2/1981 | European Pat. Off. | 70/276 |
| 0345372 | 12/1989 | European Pat. Off. | 70/276 |
| 2262770 | 6/1993 | United Kingdom | 292/DIG. 27 |
| 9111582 | 8/1991 | WIPO | 70/413 |

*Primary Examiner*—Darnell M. Boucher

*Attorney, Agent, or Firm*—Shlesinger, Arkwright & Garvey LLP

[57] ABSTRACT

A magnetic card key-operated locking device is disclosed. The locking and opening motion of the locking device is performed by a magnetic interaction between the card key and a plurality of magnetized pins. The pins are movably placed in a plurality of holes of a perforated stationary plate, a perforated operating plate and a movable plate. The pins are repulsed by a magnetic plate to cause the operating plate to be coupled to the stationary plate and thereby lock the locking device when there is no card key in a key insert slot. However, when there is a card key in the key insert slot, the pins are repulsed by the card key toward the magnetic plate to cause the operating plate to be separated from the stationary plate but to be coupled to said movable plate and thereby open the locking device.

5 Claims, 6 Drawing Sheets

MAGNETIC CARD KEY-OPERATED LOCKING DEVICE

BACKGROUND OF THE INVENTION

1. Field of the Invention

The present invention relates in general to a locking device for doors and, more particularly, to a locking device locked and opened by a magnetic card key, the locking and opening motion of the above locking device being performed by a magnetic interaction between a magnetic force distributed in the card key and a plurality of magnetized pins of the locking device.

2. Description of the Prior Art

As well known to those skilled in the art, various types of locking devices for doors have been proposed. In a conventional locking device for doors, both a lock and inside and outside handle knobs are installed in a door. The above lock includes a locking cylinder with a plurality of spring-biased operating pins. A key slot for receiving a key having specific cuts is axially formed in the center of the locking cylinder. The inside handle knob is provided with a push button for locking the locking device inside the door.

As the above locking device is to be opened by moving the operating pins using a key having specific cuts, the locking device may be somewhat easily picked by any metal object with similar shapes and cuts by someone other than the owner. Therefore, the above locking device does not provide adequate protection from intruders. Therefore, at least one auxiliary lock in addition to the above locking device may be installed in the door in order to achieve improved security. However, such an auxiliary lock would increase the cost. Furthermore, the auxiliary lock cannot achieve the expected security as it too may be picked by any metal object with similar shapes and cuts by someone other than the owner in the same manner as described for the above locking device.

In order to rectify the above problems, a magnetic card key-operated locking device for doors has been proposed. This card key-operated locking device includes both a locking unit and an identifying unit. The identifying unit is for identifying authorized people. In order to open up the door provided with the above locking device, an identifying magnetic card is inserted in the identifying unit. A releasing button of the locking unit may be operated only after the identifying unit identifies the authorized person from the inserted card. That is, the above magnetic card is not used as a key for opening the locking unit but as means for identifying authorized people. In addition, there is another type of magnetic card key-operated locking device wherein a magnetized card is brought into direct contact with a locking unit and thereby opens the locking device by a magnetic interaction between a magnetized contact surface of the card and the locking unit. However, as the locking unit of the above locking device has a simple construction, the locking device may be easily picked by any magnetic material.

SUMMARY OF THE INVENTION

It is, therefore, an object of the present invention to provide an improved magnetic card key-operated locking device in which the above problems can be overcome and which includes a lock operating unit provided with a plurality of magnetically operated pins movably placed in a plurality of holes of the lock operating unit thereby operating a lock by a magnetic interaction between a magnetic force distributed in a card key and the pins and being locked or opened.

In an embodiment of the present invention, the magnetically operated pins are movably received in a plurality of holes formed in all of a bent movable plate, a perforated operating plate and a perforated stationary plate. The pins are normally repulsed by a magnetic plate of the lock operating unit to couple the operating plate to the stationary plate while separating the operating plate from the bent movable plate thereby maintaining the lock in a locked state. However, when a magnetic card key having a stronger magnetic force than that of the magnetic plate is inserted into a key insert slot of the lock operating unit prior to turning an outside handle knob, the pins are magnetically repulsed toward the magnetic plate and thereby separate the operating plate from the stationary plate but couple the operating plate to the bent movable plate. Both the movable plate and operating plate in this state descends by the turning motion of the outside handle knob and thereby engage a lock opening member with a rotary shaft. Thus, the lock is unlocked, opening the door. When the card key is removed from the lock operating unit after removing the turning force from the outside handle knob, the pins are repulsed by the magnetic plate and thereby return to their original positions and bring the lock into the locked state.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
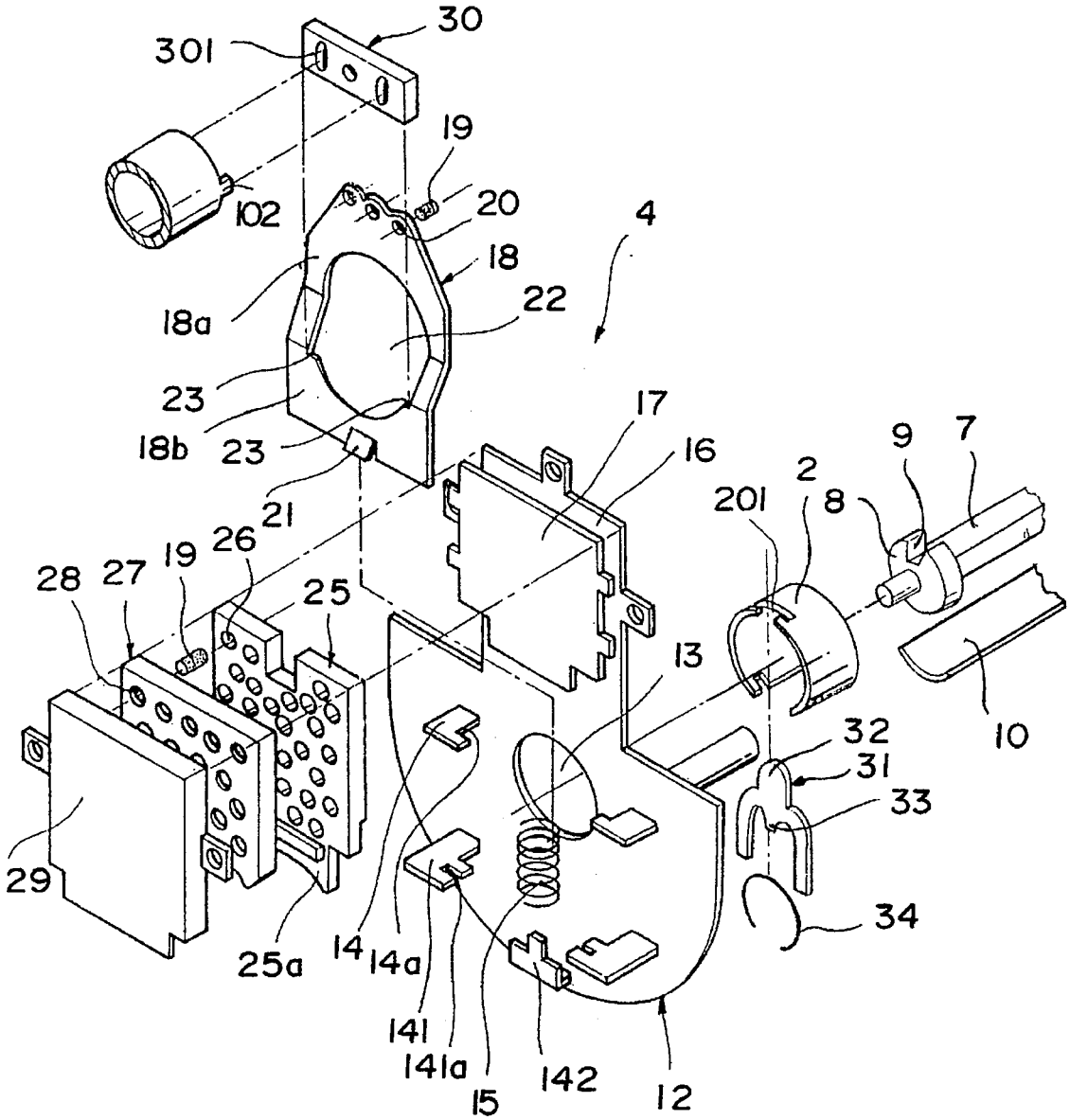
FIG. 1 is an exploded perspective view of a magnetic card key-operated locking device in accordance with a primary embodiment of the present invention.

FIGS. 1 to 5 show a magnetic card key-operated locking device in a primary embodiment of the present invention. As shown in the drawings, the locking device includes a pair of handle knobs, that is, outside and inside knobs 1 and 101 which are connected together through a connection pipe 2. Connected to the connection pipe 2 at one side of the inside knob 101 is a lock 3. The locking device also includes a lock operating unit 4 coupled to the connection pipe 2 at a portion between the outside knob 1 and the lock 3. The lock operating unit 4 includes a card key insert slot 5 into which a magnetic card key 6 will be inserted. A rotary shaft 7 axially extends in the connection pipe 2 to be connected to the lock 3. A circular block 8 with an engaging notch 9 is fixedly fitted over the rotary shaft 7 at a portion inside the lock operating unit 4. Axially extending under the rotary shaft 7 is a rotary panel 10 of arcuate cross-section. Both ends of the above panel 10 are connected to the opposite handle knobs 1 and 101 respectively.

A fixing plate 12 is fitted over the connection pipe 2 and mounted to a lock operating unit's body 11. The fixing plate 12 has an opening 13 for receiving the connection pipe 2 therein. Two pairs of guiders 14 and 141 having their own guide notches 14*a* and 141*a* are provided on upper and lower portions of the fixing plate 12 respectively as best seen in FIG. 1. Each pair of guiders 14 or 141 are symmetrically placed in left and right sides of the fixing plate 12 about the central axis vertically passing the opening 13. Mounted to a bottom portion of the fixing plate 12 is a spring holder 142. The bottom end of a coil spring 15 is fitted over and held by the spring holder 142. The fixing plate 12 has a top portion 16 having a narrower width. This top portion of the plate 12 is used as a mount bracket portion as will be described later herein.

Figure 2:
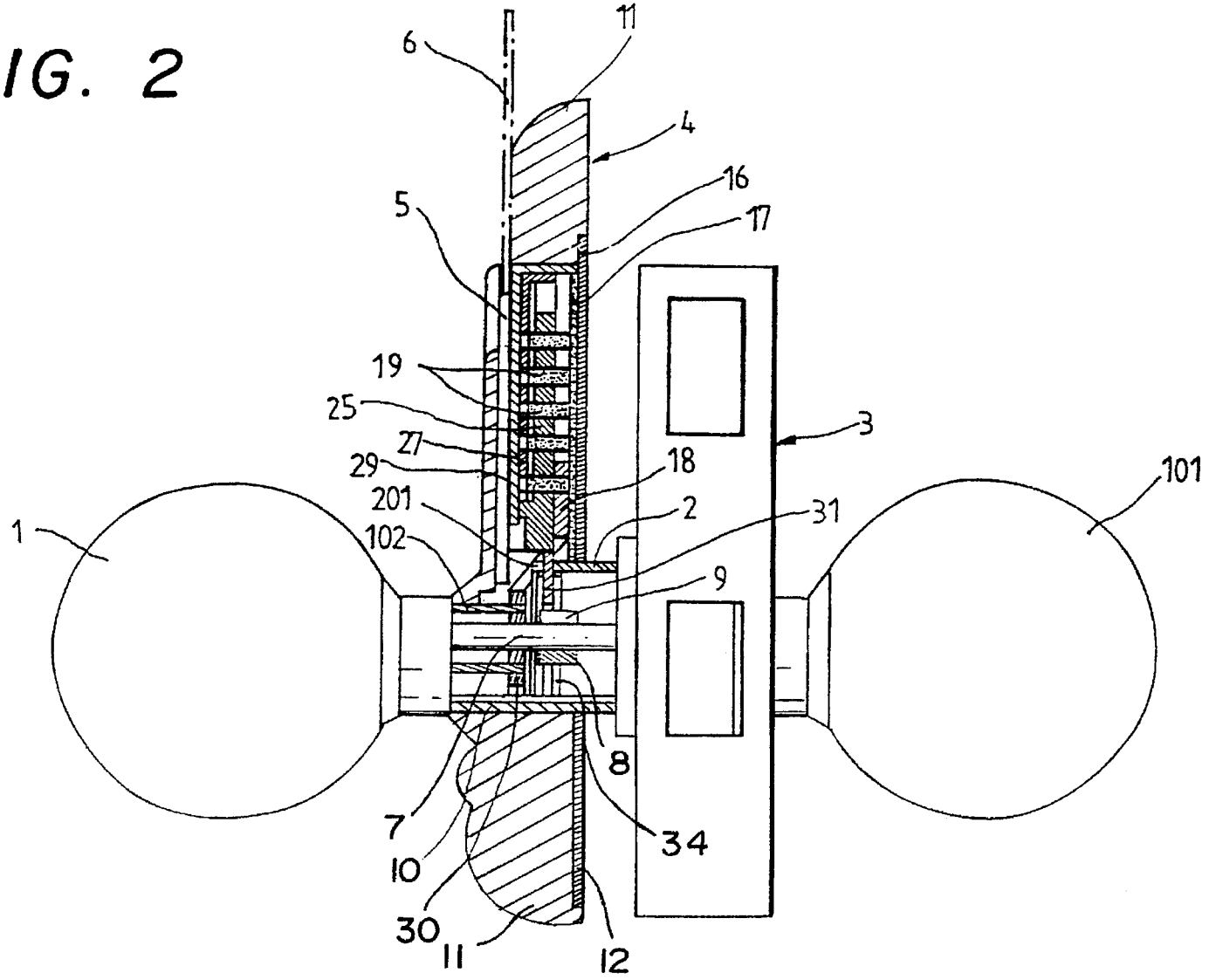
FIG. 2 is a sectional view of the locking device of FIG. 1 after assembling the parts into the locking device.
Figure 3:
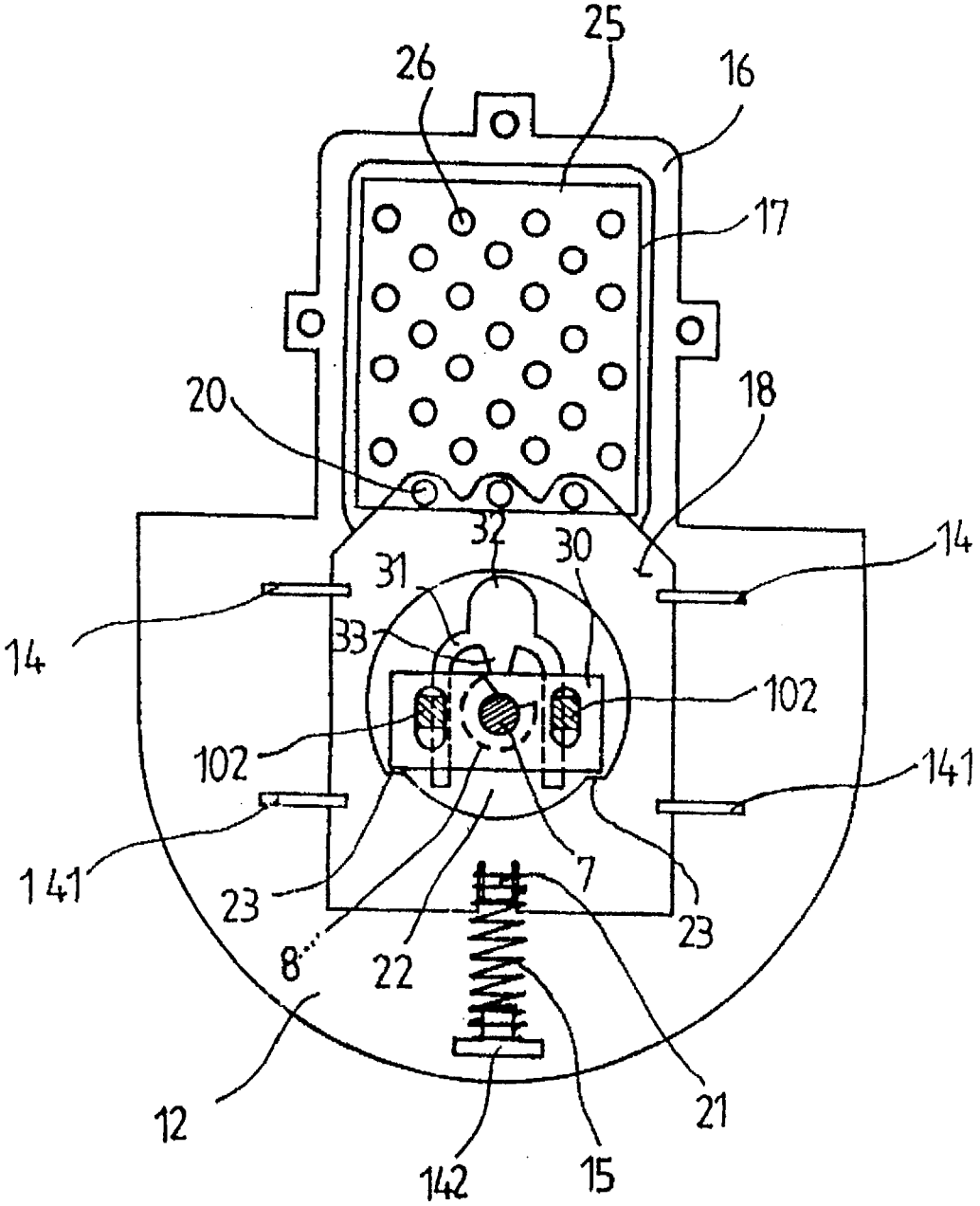
FIG. 3 is a view showing the construction of a lock operating unit of the above locking device.

The above top portion 16 of the plate 12 is for fixedly mounting both a magnetic plate 17 and perforated stationary plate 27 to the plate 12. As shown in FIGS. 1 and 2, both a movable plate 18 and perforated operating plate 25 are movably interposed between the magnetic plate 17 and the perforated stationary plate 27. The movable plate 18 is bent at its middle portion thereby forming upper and lower portions 18*a* and 18*b* connected together through the middle bent portion. The movable plate's upper portion 18*a* is provided with a plurality of, for example three, holes 20 for receiving a plurality of magnetically operated pins 19 therein, while the lower portion 18*b* is provided with a spring holder 21 for holding the top end of the coil spring 15. The movable plate 18 is provided with a central opening 22. This opening 22 has a pair of stepped shoulders 23 in its both sides. Opposite sides of the movable plate's upper portion 18*a* are movably received in the guide notches 14*a* of the upper guiders 14, while opposite sides of the lower portion 18*b* are movably received in the guide notches 141*a* of the lower guiders 141. The stationary plate 27 is mounted to the mount bracket portion 16 of the fixing plate 12 by a casing plate 29. When mounting the stationary plate 27 to the mount bracket portion 16, the perforated operating plate 25, the movable plate 18 and the magnetic plate 17 are placed one after another from the stationary plate 27 toward the mount bracket portion 16 as shown in FIG. 2. The operating plate 25 has a plurality of holes 26 for receiving a plurality of magnetically operated pins 19. The bottom of the operating plate 25 is provided with a pressing portion 25*a*. This pressing portion 25*a* will selectively press down a lock opening member 31 as will be described later herein. The stationary plate 27 is provided with a plurality of holes 28 corresponding to the holes 26 of the operating plate 25.

A rectangular cam 30 with opposite fitting holes 301 is placed in the central opening 22 of the movable plate 18. Opposite ends of the rectangular cam 30 are seated on the stepped shoulders 23 of the central opening 22. The cam 30 is also placed in the connection pipe 2. The cam 30 is coupled to the outside handle knob 1 by fitting a pair of fitting protrusions 102 of the knob 1 into the fitting holes 301 of the cam 30. Therefore, the cam 30 will be rotated by a turning motion of the knob 1.

The connection pipe 2 is provided with a slit 201 for receiving the above-mentioned lock opening member 31. This lock opening member 31 is provided with a head 32 and an engaging protrusion 33. The above opening member 31 is biased upward by an elastic member 34. The engaging protrusion 33 of the opening member 31 will selectively engage with the engaging notch 9 of the rotary shaft's circular block 8 when the opening member 31 is pressed down by the operating plate 25. The opening member 31 in this state engages with the rotary shaft 7.

The operational effect of the above locking device will be described hereinbelow.

When there is no magnetic card key 6 in the key insert slot 6, the magnetically operated pins 19 are repulsed by the magnetic plate 17. The operating plate 25 in this state is coupled to the stationary plate 27 but separated from the movable plate 18. Therefore, the lock 3 maintains its locked state. When the magnetic card key 6 is inserted into the key insert slot 5 of the lock operating unit 4 as shown in FIG. 2, the magnetically operated pins 19 movably received in the holes 20, 26 and 28 of the plates 18, 25 and 27 are repulsed by the magnetic force of the card key 6.

That is, all of the pins 19 are repulsed toward the magnetic plate 17 by the card key 6 as the magnetic force of the card key 6 is stronger than that of the magnetic plate 17. Therefore, the operating plate 25 is separated from the stationary plate 27 but brought into engagement with the movable plate 18.

Figure 4:
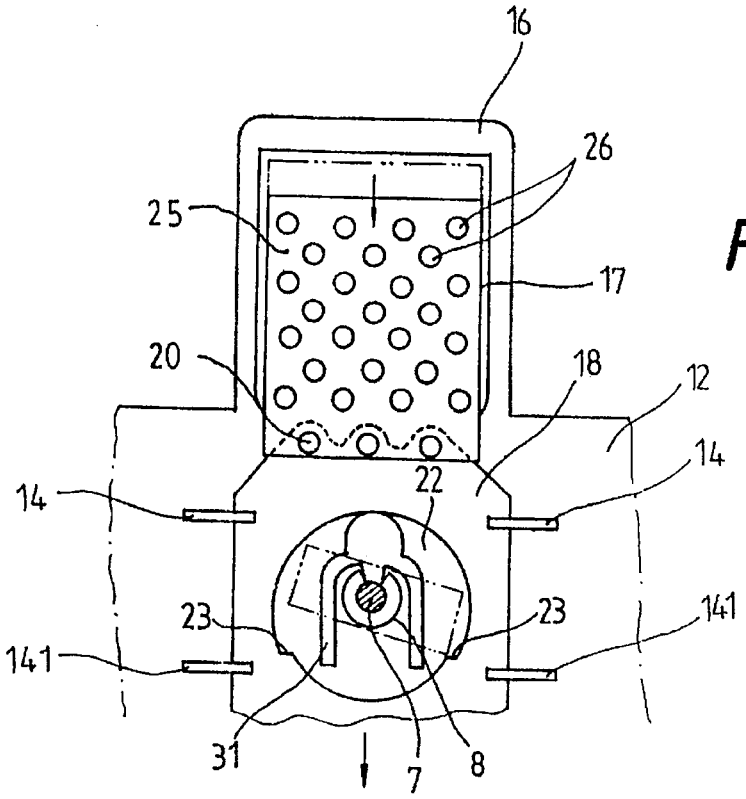
FIGS. 4 and 5 are views showing the operation of the above lock operating unit for opening the locking device.
Figure 5:
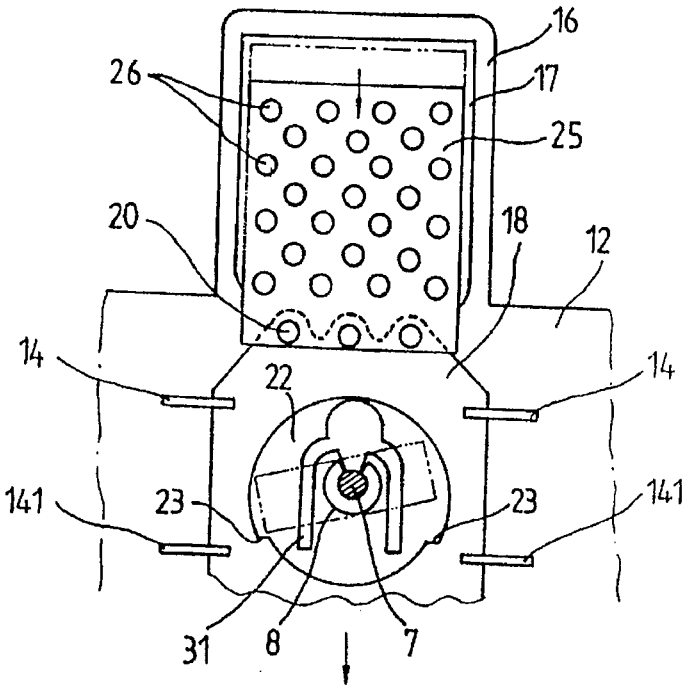

In the above state, the outside handle knob 1 is rotated. When the handle knob 1 in the above state is rotated in either direction, the rectangular cam 30 is turned in the same direction and thereby presses down either stepped shoulder 23 of the movable plate 18 as shown in FIGS. 4 and 5. Therefore, the movable plate 18 along with the operating plate 25 descends under the guide of the upper and lower guiders 14 and 141 of the fixing plate 12.

When the movable plate 18 along with the operating plate 25 descends as described above, the pressing portion 25*a* of the operating plate 25 presses down the head 32 of the lock opening member 31 and in turn makes the engaging protrusion 33 of the member 31 be inserted into the engaging notch 9 of the rotary shaft's circular block 8 as shown in FIGS. 4 and 5. Therefore, the lock opening member 31 engages with the rotary shaft 7. In this case, the either directional rotating angle of the outside handle knob 1 is limited to about 6°. In addition, the engaging notch 9 of the rotary shaft's circular block 8 is formed in consideration of the above handle knob's rotating angle. As the lock opening member 31 engages with the rotary shaft 7 as described above, both the rotary shaft 7 and rotary panel 10 in the connection pipe 2 can be rotated at the same time by a rotating motion of the handle knob 1. The rotating motion of both the shaft 7 and panel 10 opens the lock 3.

When an external turning force is removed from the outside handle knob 1 in the above state, the rectangular cam 30 returns to its original position. In this state, the lock opening member 31 and the movable plate 18 along with the operating plate 25 are elastically lifted up by the elastic member 34 and the coil spring 15 respectively. Thereafter, the card key 6 is removed from the key insert slot 5. All of the operating pins 19 are thus repulsed by the magnetic plate 17 thereby coupling the operating plate 25 to the stationary plate 27 and separating the plate 25 from the movable plate 18. Therefore, the lock 3 is brought into the locked state. As the lock opening member 31 in the above state is separated from the rotary shaft 7, the rotary shaft 7 is not even rotated when either handle knob 1 or 101 is turned. That is, the handle knobs 1 and 101 in the above state run idle and thereby cannot open up the door.

Figure 6:
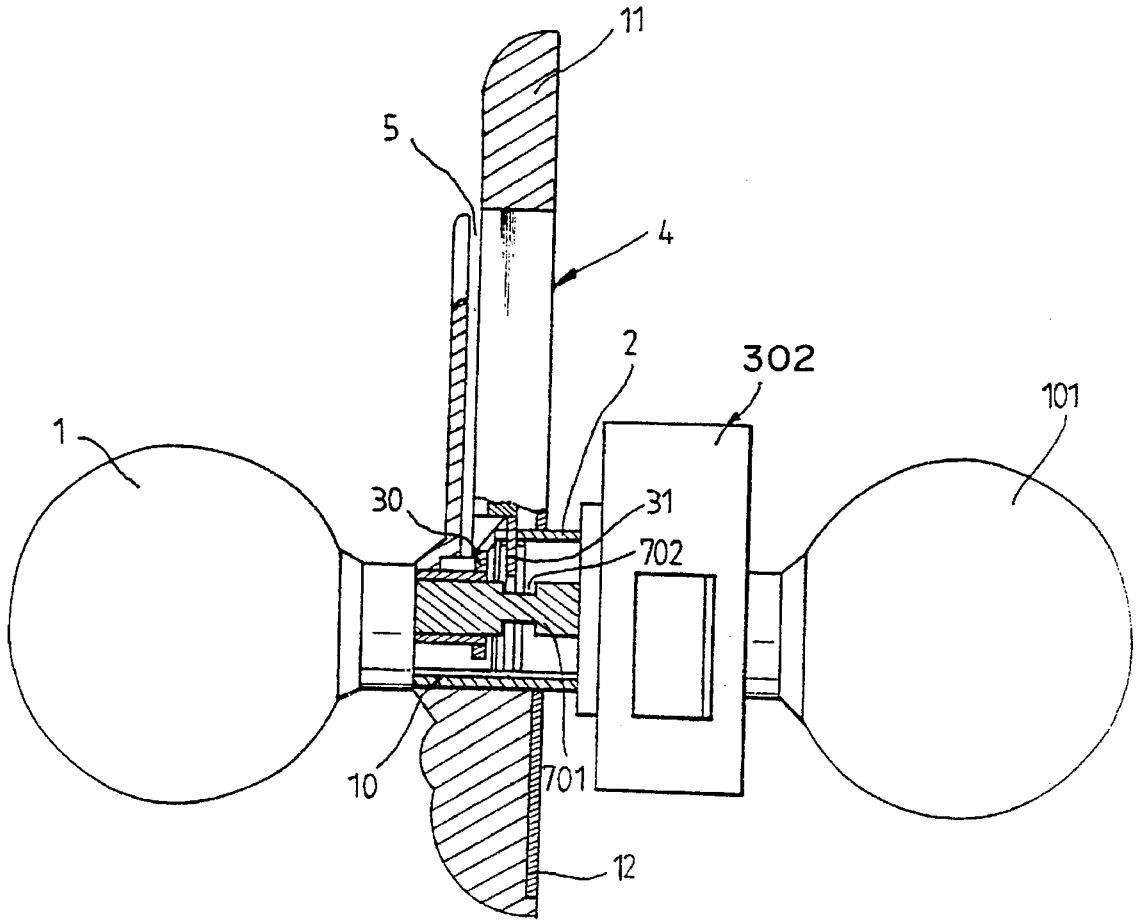
FIG. 6 is a view corresponding to FIG. 2, but showing a second embodiment of the present invention.

FIG. 6 shows a magnetic card key-operated locking device in accordance with a second embodiment of this invention. Most of the elements of the second embodiment are common with those of the primary embodiment. Those elements common to both the primary embodiment and the second embodiment will thus carry the same reference numerals. In the above second embodiment, the rotary shaft 702 extending in the connection pipe 2 is provided with a small-diameter portion 702. The lock 302 is locked by an axial movement of the rotary shaft 701.

In the operation of the above locking device, both the movable plate 18 and lock opening member 31 descend by the magnetic card key 6 inserted into the key insert slot 6. Both the movable plate 18 and lock opening member 31 are brought into engagement with the small-diameter portion 702 of the shaft 701 and thereby open the lock 302.

Figure 7A:
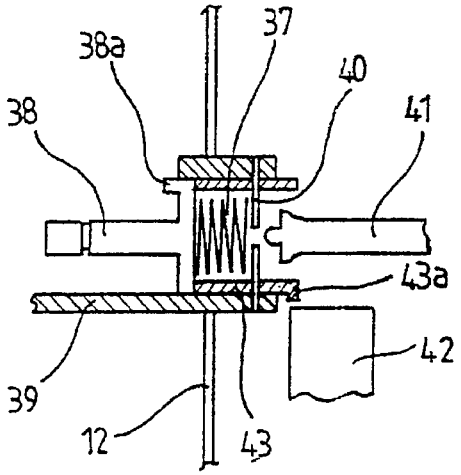
FIG. 7 is a view showing a rotary shaft preferably used with a tramyth NP type of locking device in accordance with another embodiment of the present invention.
Figure 7B:
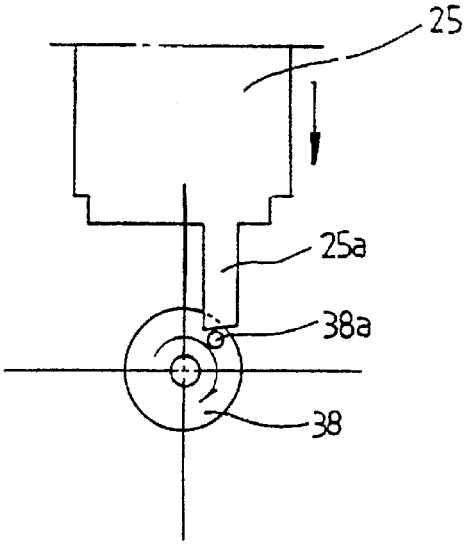

FIG. 7 shows a rotary shaft in accordance with another embodiment of this invention. The rotary shaft of this embodiment is preferably used with a tramyth NP type of locking device. In this rotary shaft, a locking cam 38 is fixedly coupled to a pipe 43. A locking base 39 is movably fitted into the fixing plate 12. Both the locking cam 38 and pipe 39 are fitted in the locking base 39 and rotatable individually. A vertically placed cam base 40 selectively advances when the base 40 engages with a tail bar 41. This cam base 40 also retracts when the locking device is opened. The retracting motion of the cam base 40 is performed by a spring 37. The pipe 43 has a protrusion 43*a*. This protrusion 43*a* vertically moves a retractor 42 so as to move a latch (not shown).

In order to lock the locking device provided with the above rotary shaft, an inside button (not shown) connected to the tail bar 41 is pushed and thereby causes the tail bar 41 to engage with the cam base 40. When an outside handle knob is rotated in the above state, the locking base 39 is exclusively rotated, while both the locking cam 38 and pipe 43 maintain their previous positions without any movements. Therefore, the outside handle knob runs idle and thereby cannot open up the door.

In order to open the above locking device, the outside handle knob is rotated under the condition that a magnetic card key 6 is inserted into the key insert slot 6 of the lock operating unit 4. Therefore, the movable plate 18 along with the operating plate 25 descends and thereby causes the pressing portion 25*a* of the plate 25 to press down a locking cam's protrusion 38*a*. The locking cam 38 is thus rotated at a rotating angle of about 45°.

As a result of the above locking cam's rotation of about 45° angle, both the locking cam 38 and pipe 43 are rotated. Therefore, the pipe's protrusion 43*a* presses down the retractor 43, while the tail bar 41 moves backward. The latch is brought into a movable state and thereby opens the locking device and opens up the door.

As described above, the present invention provides a security locking device locked or opened by a magnetic card key. The locking device of this invention is easily installed in any door, smoothly operated and generally used with various types of locks for doors. The locking device scarcely has any operational trouble as it can be smoothly operated as described above. As the magnetic force distribution in the card key may be changed as demanded, the security of the above locking device can be further improved. The instant locking device removes necessity for either a conventional key or an auxiliary lock. This locking device can not be picked by a magnetic material other than the authorized magnetic card key. As the locking device has no conventional key slot outside the door, the locking device can be neither picked by any metal object with similar shapes and cuts nor disassembled outside the door by someone other than the owner.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A magnetic card key-operated locking device comprising;

a connection pipe connecting inside and outside handle knobs together, said connection pipe having a slit;

a lock coupled to said connection pipe at a side of said inside handle knob; and a lock operating unit coupled to said connection pipe between said outside handle knob and said lock, said lock operating unit including;

a body;

a rotary shaft axially extending in the connection pipe and having means thereon for connecting the shaft to said lock;

a rotary panel axially extending under said rotary shaft, both ends of said panel being connected to the handle knobs respectively;

a card key insert slot formed in said body;

a fixing plate mounted to said body and fitted over said connection pipe, said fixing plate having two pairs of guiders and a mount bracket portion;

a magnetic plate and a perforated stationary plate mounted to said mount bracket portion;

a perforated operating plate and a spring-biased movable plate movably interposed between said magnetic plate and said perforated stationary plate, said movable plate being perforated at its top portion and having a central opening provided with opposite stepped shoulders;

a plurality of magnetically operated pins movably placed in a plurality of holes of said stationary plate, operating plate and movable plate, said pins being repulsed by the magnetic plate to cause the operating plate to be coupled to said stationary plate but to be separated from the movable plate when there is no magnetic card key in said card key insert slot, said pins being repulsed by a magnetic card key toward said magnetic plate to cause the operating plate to be separated from the stationary plate but to be coupled to said movable plate when said card key is inserted in the card key insert slot;

a rectangular cam coupled to the outside handle knob and seated on the stepped shoulders of the central opening of said movable plate, said cam being selectively rotated by a turning motion of said outside handle knob thereby lowering the movable plate along with the operating plate when said card key is inserted in the key insert slot; and a lock opening member movably received in said slit of said connection pipe, said lock opening member being selectively pressed down by said operating plate thereby being brought into engagement with the connecting means of the rotary shaft for opening the locking device.

2. The magnetic card key-operated locking device according to claim 1, wherein said connecting means on the rotary shaft is a small-diameter portion and said lock is locked or opened by an axial movement of said rotary shaft.

3. The magnetic card key-operated locking device according to claim 1, wherein said connecting means on the rotary shaft is a locking cam having a protrusion, said protrusion being selectively pressed down by said operating plate thereby rotating the locking cam to open the locking device.

4. The magnetic key-operated locking device according to claim 1, wherein said connecting means on the rotary shaft is a circular block provided with an engaging notch.

5. A magnetic card key-operated locking device comprising:

a connection pipe connecting inside and outside handle knobs together, said connection pipe having a slit;

a lock coupled to said connection pipe at a side of said inside handle knob; and a lock operating unit coupled to said connection pipe between said outside handle knob and said lock, said lock operating unit including:

a body;

a rotary shaft axially extending in the connection pipe and being connected to said lock, said rotary shaft having a connection member thereon for connecting the shaft to said lock;

a rotary panel axially extending under said rotary shaft, both ends of said panel being connected to the handle knobs respectively;

a card key insert slot formed in said body;

a fixing plate mounted to said body and fitted over said connection pipe, said fixing plate having two pairs of guiders and a mount bracket portion;

a magnetic plate and a perforated stationary plate mounted to said mount bracket portion;

a perforated operating plate and a spring-biased movable plate movably interposed between said magnetic plate and said perforated stationary plate, said movable plate being perforated at its top portion and having a central opening provided with opposite stepped shoulders;

a plurality of magnetically operated pins movable placed in a plurality of holes of said stationary plate, operating plate and movable plate, said pins being repulsed by the magnetic plate to cause the operating plate to be coupled to said stationary plate but to be separated from the movable plate when there is no magnetic card key in said card key insert slot, said pins being repulsed by a magnetic card key toward said magnetic plate to cause the operating plate to be separated from the stationary plate but to be coupled to said movable plate when said card key is inserted in the card key insert slot;

a rectangular cam coupled to the outside handle knob and seated on the stepped shoulders of the central opening of said movable plate, said cam being selectively rotated by a turning motion of said outside handle knob thereby lowering the movable plate along with the operating plate when said card key is inserted in the key insert slot; and a lock opening member movably received in said slit of said connection pipe, said lock opening member being selectively pressed down by said operating plate thereby being brought into engagement with the connection member of the rotary shaft for opening the locking device.

* * * * *